US006247184B1

(12) United States Patent
Watts

(10) Patent No.: US 6,247,184 B1
(45) Date of Patent: Jun. 19, 2001

(54) CONFORMABLE PAIR OF UNDERWEAR

(76) Inventor: Derrick Watts, 1755 E. Tulpehocken, Philadelphia, PA (US) 19138

( * ) Notice: Subject to any disclaimer, the term of this patent is extended or adjusted under 35 U.S.C. 154(b) by 0 days.

(21) Appl. No.: 09/667,464

(22) Filed: Sep. 22, 2000

(51) Int. Cl.[7] ..... A41D 9/00; A41D 5/00
(52) U.S. Cl. ..... 2/400; 2/406; 2/67
(58) Field of Search ..... 2/400–408, 67, 2/228, 238; 604/396–398

(56) References Cited

U.S. PATENT DOCUMENTS

| | | | | |
|---|---|---|---|---|
| 2,419,867 | * | 4/1947 | Woodman | 2/400 |
| 2,431,571 | * | 11/1947 | Lehr | 2/400 |
| 2,743,456 | * | 5/1956 | Yarnell | 2/406 |
| 3,145,394 | * | 8/1964 | Melton | 2/400 |
| 3,243,824 | * | 4/1966 | Overholt | 2/406 |
| 4,280,230 | | 7/1981 | LaFleur . | |
| 4,675,918 | | 6/1987 | O'Brien . | |
| 4,802,469 | | 2/1989 | Gollestani . | |
| 4,835,795 | | 6/1989 | Lonon . | |
| 4,951,321 | | 8/1990 | Mortensen . | |
| 4,961,234 | | 10/1990 | Leibman . | |
| 5,103,501 | | 4/1992 | Meisels . | |
| 5,347,657 | * | 9/1994 | Unsell | 2/67 |
| 5,546,608 | * | 8/1996 | Russano | 2/408 |
| 5,551,093 | * | 9/1996 | Stricker | 2/406 |
| 5,991,920 | * | 11/1999 | Holland | 2/67 |

* cited by examiner

*Primary Examiner*—Gloria M. Hale
(74) *Attorney, Agent, or Firm*—Goldstein Law Offices, P.C.

(57) ABSTRACT

A conformable pair of underwear including a central member positionable over a crotch area and backside of the individual. The central member has opposed forward and rearward ends. The central member is fabricated of a cotton-like material. A front member is secured to the forward end of the central member for positioning above the crotch area of the individual. The front member has a first side edge and a second side edge. The first side edge has a plurality of male fasteners disposed thereon in a spaced relationship. The second side edge has a plurality of female fasteners disposed thereon in a spaced relationship. A back member is secured to the rearward end of the central member for positioning above the back side of the individual. The back member has a first side edge and a second side edge. The first side edge has a plurality of female fasteners disposed thereon in a spaced relationship. The second side edge has a plurality of male fasteners disposed thereon in a spaced relationship. The female and male fasteners are selectively engaged with the male and female fasteners of the front member when the front member and the back member are wrapped around a waist of the individual.

3 Claims, 2 Drawing Sheets

CONFORMABLE PAIR OF UNDERWEAR

BACKGROUND OF THE INVENTION

The present invention relates to a conformable pair of underwear and more particularly pertains to allowing securement to an individual without requiring them to lift their leg risking loss of balance.

The use of clothing items is known in the prior art. More specifically, clothing items heretofore devised and utilized for the purpose of covering parts of the human body are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,675,918 to O'Brien discloses a one piece brief with hook and pile closures. U.S. Pat. No. 4,802,469 to Gollestani discloses a therapeutic body suit. U.S. Pat. No. 4,835,795 to Lonon discloses a body suit and underpants with self-gripping fasteners. U.S. Pat. No. 4,951,321 to Mortensen et al. discloses a novelty undergarment. U.S. Pat. No. 4,961,234 to Leibman discloses an outer garment with detachable crotch piece. U.S. Pat. No. 5,103,501 to Meisels discloses a traveling and disposable underwear.

While these devices fulfill their respective, particular objective and requirements, the aforementioned patents do not describe a conformable pair of underwear for allowing securement to an individual without requiring them to lift their leg risking loss of balance.

In this respect, the conformable pair of underwear according to the present invention substantially departs from the conventional concepts and designs of the prior art, and in doing so provides an apparatus primarily developed for the purpose of allowing securement to an individual without requiring them to lift their leg risking loss of balance.

Therefore, it can be appreciated that there exists a continuing need for a new and improved conformable pair of underwear which can be used for allowing securement to an individual without requiring them to lift their leg risking loss of balance. In this regard, the present invention substantially fulfills this need.

SUMMARY OF THE INVENTION

In the view of the foregoing disadvantages inherent in the known types of clothing items now present in the prior art the present invention provides an improved conformable pair of underwear. As such, the general purpose of the present invention, which will be described subsequently in greater detail, is to provide a new and improved conformable pair of underwear which has all the advantages of the prior art and none of the disadvantages.

To attain this, the present invention essentially comprises a central member positionable over a crotch area and backside of the individual. The central member has opposed forward and rearward ends. The central member is fabricated of a cotton-like material. A front member is secured to the forward end of the central member for positioning above the crotch area of the individual. The front member is essentially perpendicular to the central member. The front member has a first side edge and a second side edge. The first side edge has a plurality of male fasteners disposed thereon in a spaced relationship in a co-linear relationship with the front member. The second side edge has a plurality of female fasteners disposed thereon in a spaced relationship in a co-linear relationship with the front member. A back member is secured to the rearward end of the central member for positioning above the back side of the individual. The back member is essentially perpendicular to the central member. The back member has a first side edge and a second side edge. The first side edge has a plurality of female fasteners disposed thereon in a spaced relationship in a co-linear relationship with the back member. The second side edge has a plurality of male fasteners disposed thereon in a spaced relationship in a co-linear relationship with the back member. The female and male fasteners are selectively engaged with the male and female fasteners of the front member when the front member and the back member are wrapped. around a waist of the individual.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved conformable pair of underwear which has all the advantages of the prior art clothing items and none of the disadvantages.

It is another object of the present invention to provide a new and improved conformable pair of underwear which may be easily and efficiently manufactured and marketed.

It is a further object of the present invention to provide a new and improved conformable pair of underwear which is of durable and reliable construction.

An even further object of the present invention is to provide a new and improved conformable pair of underwear which is susceptible of a low cost of manufacture with regard to both materials and labor, and which accordingly is then susceptible of low prices of sale to the consuming public, thereby making such a conformable pair of underwear economically available to the buying public.

Even still another object of the present invention is to provide a new and improved conformable pair of underwear for allowing securement to an individual without requiring them to lift their leg risking loss of balance.

Lastly, it is an object of the present invention to provide a new and improved conformable pair of underwear including a central member positionable over a crotch area and backside of the individual. The central member has opposed forward and rearward ends. The central member is fabricated of a cotton-like material. A front member is secured to the forward end of the central member for positioning above the crotch area of the individual. The front member has a first side edge and a second side edge. The first side edge has a plurality of male fasteners disposed thereon in a spaced relationship. The second side edge has a plurality of female fasteners disposed thereon in a spaced relationship. A back member is secured to the rearward end of the central member for positioning above the back side of the individual. The back member has a first side edge and a second side edge. The first side edge has a plurality of female fasteners disposed thereon in a spaced relationship. The second side edge has a plurality of male fasteners disposed thereon in a spaced relationship. The female and male fasteners are selectively engaged with the male and female fasteners of the front member when the front member and the back member are wrapped if around a waist-of the individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
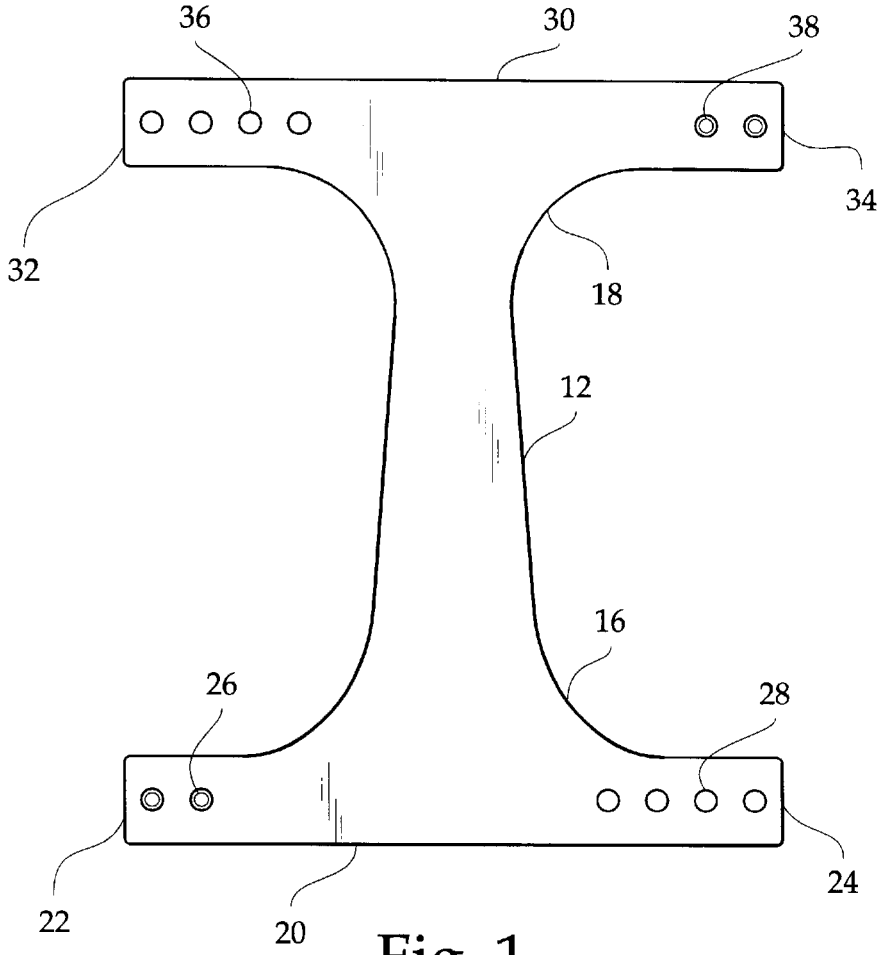
FIG. 1 is a plan view of the preferred embodiment of the conformable pair of underwear constructed in accordance with the principles of the present invention.
Figure 2:
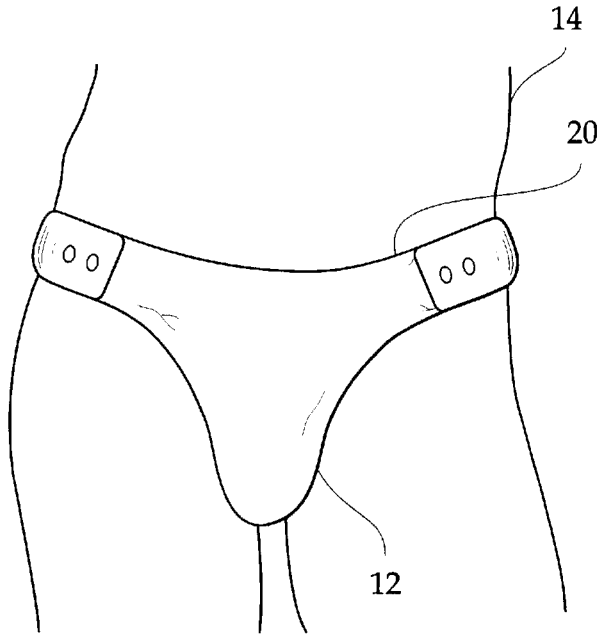
FIG. 2 is a front view of the present invention illustrated in use.

With reference now to the drawings, and in particular, to FIGS. 1 through 4 thereof, the preferred embodiment of the new and improved conformable pair of underwear embodying the principles and concepts of the present invention and generally designated by the reference number 10 will be described.

Specifically, it will be noted in the various figures that the device relates to a conformable pair of underwear for allowing securement to an individual without requiring them to lift their leg risking loss of balance. In its broadest context, the device consists of a central member, a front member, and a back member. Such components are individually configured and correlated with respect to each other so as to attain the desired objective.

The central member 12 is positionable over a crotch area and backside of the individual 14. The central member 12 has opposed forward 16 and rearward ends 18. The central member 12 is fabricated of a cotton-like material.

The front member 20 is secured to the forward end 16 of the central member 12 for positioning above the crotch area of the individual 14. The front member 20 is essentially perpendicular to the central member 12. The front member 20 has a first side edge 22 and a second side edge 24. The first side edge 22 has a plurality of male fasteners 26 disposed thereon in a spaced relationship in a co-linear relationship with the front member 20. The second side edge 24 has a plurality of female fasteners 28 disposed thereon in a spaced relationship in a co-linear relationship with the front member 20.

The back member 30 is secured to the rearward end 18 of the central member 12 for positioning above the back side of the individual 14. The back member 30 is essentially perpendicular to the central member 12. The back member 30 has a first side edge 32 and a second side edge 34. The first side edge 32 has a plurality of female fasteners 36 disposed thereon in a spaced relationship in a co-linear relationship with the back member 30. The second side edge 34 has a plurality of male fasteners 38 disposed thereon in a spaced relationship in a co-linear relationship with the back member 30. The female and male fasteners 36,38 are selectively engaged with the male and female fasteners 26,28 of the front member 20 when the front member 20 and the back member 30 are wrapped around a waist of the individual 14. The male fasteners 26 of the first side edge 22 of the front member 20 will be engaged to the female fasteners 36 of the first side edge 32 of the back member. The female fasteners 28 of the second side edge 24 of the front member 20 will be engaged to the male fasteners 38 of the second side edge 34 of the back member 30.

Figure 3:
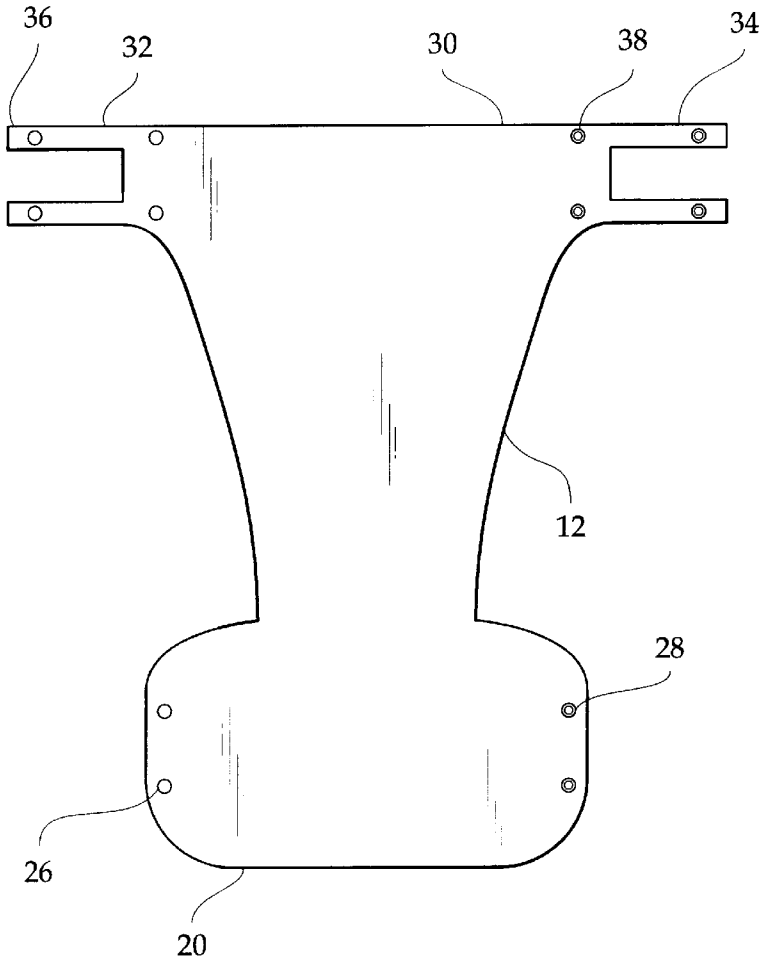
FIG. 3 is a plan view of a second embodiment of the present invention.

A second embodiment of the present invention is shown in FIG. 3 and includes substantially all of the components of the present invention wherein the front member 20 has a rectangular configuration for covering the crotch area of the individual. Furthermore, the back member 30 tapers outwardly from the central member 12 with the first and second side edges 32,34 thereof are bifurcated.

Figure 4:
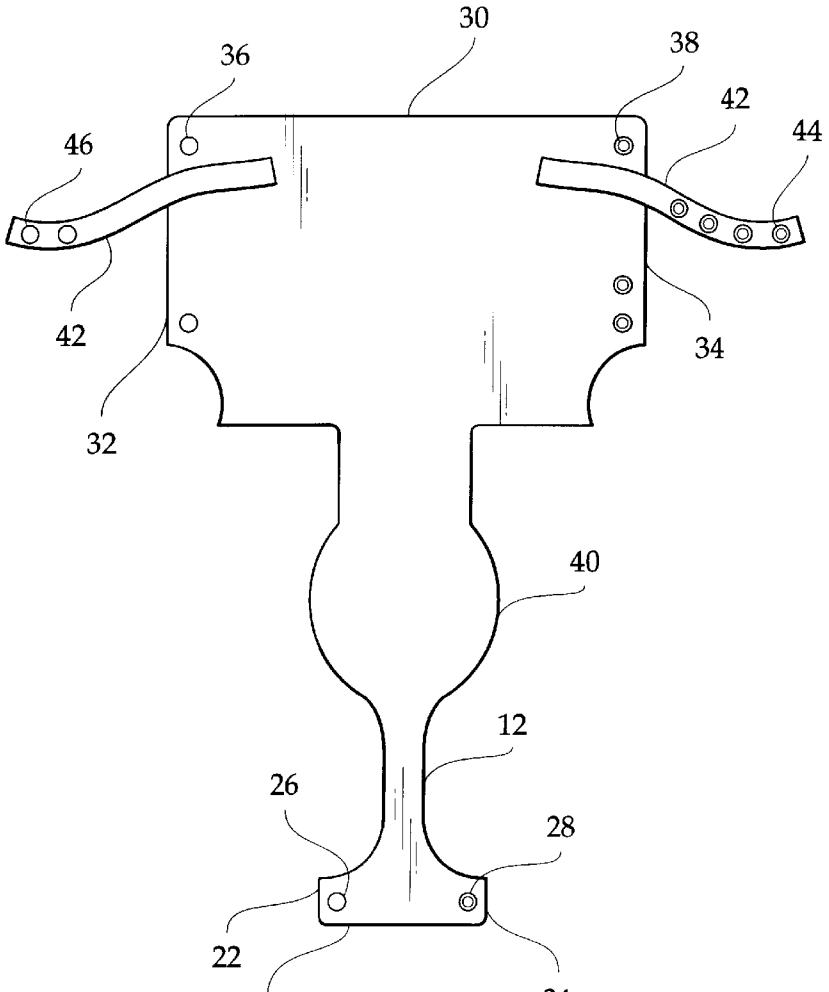
FIG. 4 is a plan view of a third embodiment of the present invention.

A third embodiment of the present invention is shown in FIG. 4 and includes substantially all of the components of the present invention wherein the central member 12 is provided with a rounded central section 40 for containing the genitals of the individual 14. Additionally, the front member 20 is T-shaped and the back member 30 is square shaped. The back member 30 has a pair of straps 42 that freely extend outwardly from the first and second side edges 32,34 thereof with male and female snaps 44,46 thereon for selectively engaging the male and female snaps 24,26 of the front member 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A conformable pair of underwear for allowing securement to an individual without requiring them to lift their leg risking loss of balance comprising, in combination:

a central member positionable over a crotch area and backside of the individual, the central member having opposed forward and rearward ends, and a rounded central section for positioning over the crotch area, the central member being fabricated of a cotton-like material;

a front member secured to the forward end of the central member for positioning above the crotch area of the individual, the front member having a first side edge and a second side edge, the first side edge having a plurality of male fasteners disposed thereon in a spaced relationship, the second side edge having a plurality of female fasteners disposed thereon in a spaced relationship; and a back member secured to the rearward end of the central member for positioning above the back side of the individual, the back member having a first side edge and a second side edge, the first side edge having a plurality of female fasteners disposed thereon in a spaced relationship, the second side edge having a plurality of male fasteners disposed thereon in a spaced relationship, the female and male fasteners being selectively engaged with the male and female fasteners of the front member when the front member and the back member are wrapped around a waist of the individual.

2. The conformable pair of underwear as set forth in claim 1, wherein the front member is T-shaped.

3. The conformable pair of underwear as set forth in claim 2, wherein the back member has a generally square configuration having a pair of straps extending outwardly from the first and second side edges thereof, the straps having male and female fasteners disposed thereon for selectively engaging the male and female fasteners of the front member.

* * * * *